US005993499A

United States Patent [19]

Houser

[11] Patent Number: 5,993,499

[45] Date of Patent: Nov. 30, 1999

[54] FUEL COMPOSITION CONTAINING AN ALIPHATIC AMINE AND A POLY (OXYALKYLENE) MONOOL

[75] Inventor: Keith R. Houser, Pleasant Hill, Calif.

[73] Assignee: Chevron Chemical Company, San Ramon, Calif.

[21] Appl. No.: 08/883,650

[22] Filed: Jun. 27, 1997

[51] Int. Cl.[6] ..... C01L 1/18; C01L 1/22

[52] U.S. Cl. ..... 44/412; 44/432; 44/443

[58] Field of Search ..... 44/412, 432, 443

[56] References Cited

U.S. PATENT DOCUMENTS

| | | | |
|---|---|---|---|
| 3,438,757 | 4/1969 | Honnen et al. . | |
| 3,658,494 | 4/1972 | Dorer, Jr. | 44/443 |
| 3,756,793 | 9/1973 | Robinson . | |
| 4,877,416 | 10/1989 | Campbell | 44/412 |
| 5,004,478 | 4/1991 | Vogel et al. . | |
| 5,006,130 | 4/1991 | Aiello et al. | 44/432 |
| 5,089,028 | 2/1992 | Abramo et al. | 44/347 |
| 5,242,469 | 9/1993 | Sakakibara et al. | 44/347 |
| 5,405,409 | 4/1995 | Ansari | 44/412 |
| 5,405,419 | 4/1995 | Ansari et al. | 44/412 |

*Primary Examiner*—Cephia D. Toomer
*Attorney, Agent, or Firm*—Claude J. Caroli

[57] ABSTRACT

A fuel composition comprising a major amount of hydrocarbons boiling in the gasoline or diesel range and (a) about 50 to 70 parts per million by weight of a fuel-soluble aliphatic hydrocarbyl-substituted amine having at least one basic nitrogen atom wherein the hydrocarbyl group has a number average molecular weight of about 700 to 3,000; and (b) about 35 to below about 75 parts per million by weight of a hydrocarbyl-terminated poly(oxyalkylene) monool having an average molecular weight of about 500 to about 5,000, wherein the oxyalkylene group is a $C_2$ to $C_5$ oxyalkylene group and the hydrocarbyl group is a $C_1$ to $C_{30}$ hydrocarbyl group.

34 Claims, No Drawings

FUEL COMPOSITION CONTAINING AN ALIPHATIC AMINE AND A POLY (OXYALKYLENE) MONOOL

BACKGROUND OF THE INVENTION

This invention relates to a novel fuel additive composition. More particularly, this invention relates to a fuel composition containing an aliphatic amine and a poly (oxyalkylene) monool.

It is well known that automobile engines tend to form deposits on the surface of engine components, such as carburetor ports, throttle bodies, fuel injectors, intake ports and intake valves, due to the oxidation and polymerization of hydrocarbon fuel. These deposits, even when present in relatively minor amounts, often cause noticeable driveability problems, such as stalling and poor acceleration. Moreover, engine deposits can significantly increase an automobile's fuel consumption and production of exhaust pollutants. Therefore, the development of effective fuel detergents or "deposit control" additives to prevent or control such deposits is of considerable importance and numerous such materials are known in the art.

For example, U.S. Pat. No. 3,438,757 to Honnen et al. discloses branched chain aliphatic hydrocarbon N-substituted amines and alkylene polyamines having a molecular weight in the range of about 425 to 10,000, preferably about 450 to 5,000, which are useful as detergents and dispersants in hydrocarbon liquid fuels for internal combustion engines.

U.S. Pat. No. 3,756,793 to Robinson discloses a fuel composition containing minor amounts of (a) a polyamine which is the reaction product of a halohydrocarbon having an average molecular weight between 600 to 2500 and an alkylene polyamine, and (b) an organic substance having a viscosity between 20 and 2500 cs. at 200C. This patent further discloses that a wide variety of compounds are suitable as the organic substance, including polyamines, amides, and esters or mixtures of esters, such as aliphatic diesters of dibasic aliphatic carboxylic acids. Preferred materials for use as the organic substance are described in this patent as polymers or copolymers having an average molecular weight of 300 to 5,000 which are selected from hydrocarbons, substituted hydrocarbons containing oxygen and substituted hydrocarbons containing oxygen and nitrogen. Most preferred polymeric compounds are described in this patent as polyalkylene oxides and polyether glycols.

U.S. Pat. No. 5,004,478 to Vogel et al. discloses a motor fuel for internal combustion engines which contains an additive comprising (a) an amino- or amino-containing detergent and (b) a base oil which is a mixture of (1) a polyether based on propylene oxide or butylene oxide and having a molecular weight not less than 500, and (2) an ester of a monocarboxylic or polycarboxylic acid and an alkanol or polyol.

U.S. Pat. No. 5,089,028 to Abramo et al. discloses a fuel composition containing an additive which comprises the combination of (1) a polyalkenyl succinimide, (2) a polyalkylene polymer, such as polyisobutylene or polypropylene, (3) an ester of an aliphatic or aromatic carboxylic acid, and (4) a polyether, such as polybutylene oxide, polypropylene or a polybutylene/polypropylene copolymer. The additive may also contain an optional amount of a mineral oil or a synthetic oil.

U.S. Pat. No. 5,242,469 to Sakakibara et al. discloses a gasoline additive composition comprising (a) a monoester, diester or polyolester, and (b) a dispersant selected from (1) a monosuccinimide, (2) a bis-succinimide, (3) an alkylamine having a polyolefin polymer as an alkyl group and an average molecular weight of 500–5,000, and (4) a benzylamine derivative having an average molecular weight of 500–5,000. The additive composition may additionally contain a polyoxyalkylene glycol or its derivative and/or a lubricant oil fraction.

U.S. Pat. No. 4,877,416 to Campbell discloses a fuel composition which contains (a) from about 0.001 to 1.0 percent by weight of a hydrocarbyl-substituted amine or polyamine having an average molecular weight of about 750 to 10,000 and at least one basic nitrogen atom, and (b) a hydrocarbyl-terminated poly(oxyalkylene) monool having an average molecular weight of about 500 to 5,000, wherein the weight percent of the hydrocarbyl-terminated poly (oxyalkylene) monool in the fuel composition ranges from about 0.01 to 100 times the amount of hydrocarbyl-substituted amine or polyamine.

U.S. Pat. No. 5,006,130 to Aiello et al. discloses an unleaded gasoline composition containing a mixture of (a) about 2.5 parts per million by weight or higher of basic nitrogen in the form of an oil-soluble aliphatic alkylene polyamine containing at least one olefinic polymer chain, said polyamine having a molecular weight of about 600 to 10,000, and (b) from about 75 to about 125 parts per million by weight based on the fuel composition of certain oil-soluble olefinic polymers, a poly(oxyalkylene) alcohol, glycol or polyol or a mono or di-ether thereof, non-aromatic naphthenic or paraffinic oils or polyalphaolefins. This patent further teaches that, as a matter of practicality, the basic nitrogen content of the aliphatic polyamine component is usually about 4.0 or below and that this generally corresponds to a concentration of about 100 to 160 ppm when the aliphatic polyamine is a 1050 molecular weight aliphatic diamine, such as N-polyisobutenyl N'-N'-dimethyl-1,3-diaminopropane.

U.S. Pat. No. 5,405,419 to Ansari et al. discloses a fuel additive composition comprising (a) a fuel-soluble aliphatic hydrocarbyl-substituted amine having at least one basic nitrogen atom wherein the hydrocarbyl group has a number average molecular weight of about 700 to 3,000; (b) a polyolefin polymer of a $C_2$ to $C_6$ monolefin, wherein the polymer has a number avsrage molecular weight of about 350 to 3,000; and (c) a hydrocarbyl-terminated poly (oxyalkylene) monool having an average molecular weight of about 500 to 5,000. This patent further teaches that fuel compositions containing these additives will generally contain about 50 to 500 ppm by weight of the aliphatic amine, about 50 to 1,000 ppm by weight of the polyolefin and about 50 to 1,000 ppm by weight of the poly(oxyalkylene) monool. This patent also discloses that fuel compositions containing 125 ppm each of aliphatic amine, polyolefin and poly(oxyalkylene) monool provide better deposit control performance than compositions containing 125 ppm of aliphatic amine plus 125 ppm of poly(oxyalkylene) monool.

SUMMARY OF THE INVENTION

It has now been discovered that the unique combination of an aliphatic hydrocarbyl-substituted amine and a poly (oxyalkylene) monool, when employed at very low concentrations as a fuel additive composition for hydrocarbon fuels, provides excellent control of engine deposits, especially engine intake valve deposits.

Accordingly, the present invention provides a novel fuel composition comprising a major amount of hydrocarbons boiling in the gasoline or diesel range and (a) about 50 to 70 parts per million (ppm) by weight of a fuel-soluble aliphatic hydrocarbyl-substituted amine having at least one basic nitrogen atom wherein the hydrocarbyl group has a number average molecular weight of about 700 to 3,000; and (b) about 35 to below about 75 parts per million by weight of a hydrocarbyl-terminated poly(oxyalkylene) monool having an average molecular weight of about 500 to about 5,000, wherein the oxyalkylene group is a $C_2$ to $C_5$ oxyalkylene group and the hydrocarbyl group is a $C_1$ to $C_{30}$ hydrocarbyl group.

Preferably, the fuel composition of the present invention will contain about 40 to 70 parts per million by weight of the hydrocarbyl-terminated poly(oxyalkylene) monool.

The present invention further provides a method for reducing engine deposits in an internal combustion engine which comprises operating the engine with the novel fuel composition of the present invention.

Among other factors, the present invention is based on the surprising discovery that the unique combination of an aliphatic amine and a poly(oxyalkylene) monool unexpectedly provides excellent deposit control performance at low concentrations not heretofore recognized in the art as effective for optimum deposit control.

DETAILED DESCRIPTION OF THE INVENTION

As noted above, the fuel composition of the present invention contains an aliphatic hydrocarbyl-substituted amine and a hydrocarbyl-terminated poly(oxyalkylene) monool. These compounds are described in further detail below.

A. The Aliphatic Hydrocarbyl-Substituted Amine

The fuel-soluble aliphatic hydrocarbyl-substituted amine component of the present fuel composition is a straight or branched chain hydrocarbyl-substituted amine having at least one basic nitrogen atom wherein the hydrocarbyl group has a number average molecular weight of about 700 to 3,000. Typically, such aliphatic amines will be of sufficient molecular weight so as to be nonvolatile at normal engine intake valve operating temperatures, which are generally in the range of about 175° C. to 300° C.

Preferably, the hydrocarbyl group will have a number average molecular weight in the range of about 750 to 2,200, and more preferably, in the range of about 900 to 1,500. The hydrocarbyl group will generally be branched chain.

When employing a branched-chain hydrocarbyl amine, the hydrocarbyl group is preferably derived from polymers of $C_2$ to $C_6$ olefins. Such branched-chain hydrocarbyl groups will ordinarily be prepared by polymerizing olefins of from 2 to 6 carbon atoms (ethylene being copolymerized with another olefin so as to provide a branched-chain). The branched chain hydrocarbyl group will generally have at least 1 branch per 6 carbon atoms along the chain, preferably at least 1 branch per 4 carbon atoms along the chain and, more preferably, at least 1 branch per 2 carbon atoms along the chain. The preferred branched-chain hydrocarbyl groups are derived from polypropylene and polyisobutylene. The branches will usually be of from 1 to 2 carbon atoms, preferably 1 carbon atom, that is, methyl.

In most instances, the branched-chain hydrocarbyl amines are not a pure single product, but rather a mixture of compounds having an average molecular weight. Usually, the range of molecular weights will be relatively narrow and peaked near the indicated molecular weight.

The amine component of the branched-chain hydrocarbyl amines may be derived from ammonia, a monoamine or a polyamine. The monoamine or polyamine component embodies a broad class of amines having from 1 to about 12 amine nitrogen atoms and from 1 to about 40 carbon atoms with a carbon to nitrogen ratio between about 1:1 and 10:1. Generally, the monoamine will contain from 1 to about 40 carbon atoms and the polyamine will contain from 2 to about 12 amine nitrogen atoms and from 2 to about 40 carbon atoms. In most instances, the amine component is not a pure single product, but rather a mixture of compounds having a major quantity of the designated amine. For the more complicated polyamines, the compositions will be a mixture of amines having as the major product the compound indicated and having minor amounts of analogous compounds. Suitable monoamines and polyamines are described more fully below.

When the amine component is a polyamine, it will preferably be a polyalkylene polyamine, including alkylenediamine. Preferably, the alkylene group will contain from 2 to 6 carbon atoms, more preferably from 2 to 3 carbon atoms. Examples of such polyamines include ethylene diamine, diethylene triamine, triethylene tetramine and tetraethylene pentamine. Preferred polyamines are ethylene diamine and diethylene triamine.

Particularly preferred branched-chain hydrocarbyl amines include polyisobutenyl ethylene diamine and polyisobutyl amine, wherein the polyisobutyl group is substantially saturated and the amine moiety is derived from ammonia.

The aliphatic hydrocarbyl amines employed in the fuel composition of the invention are prepared by conventional procedures known in the art. Such aliphatic hydrocarbyl amines and their preparations are described in detail in U.S. Pat. Nos. 3,438,757; 3,565,804; 3,574,576; 3,848,056; 3,960,515; and 4,832,702, the disclosures of which are incorporated herein by reference.

Typically, the hydrocarbyl-substituted amines employed in this invention are prepared by reacting a hydrocarbyl halide, such as a hydrocarbyl chloride, with ammonia or a primary or secondary amine to produce the hydrocarbyl-substituted amine.

As noted above, the amine component of the presently employed hydrocarbyl-substituted amine is derived from a nitrogen-containing compound selected from ammonia, a monoamine having from 1 to about 40 carbon atoms, and a polyamine having from 2 to about 12 amine nitrogen atoms and from 2 to about 40 carbon atoms. The nitrogen-containing compound is reacted with a hydrocarbyl halide to produce the hydrocarbyl-substituted amine fuel additive finding use within the scope of the present invention. The amine component provides a hydrocarbyl amine reaction product with, on average, at least about one basic nitrogen atom per product molecule, i.e., a nitrogen atom titratable by a strong acid.

Preferably, the amine component is derived from a polyamine having from 2 to about 12 amine nitrogen atoms and from 2 to about 40 carbon atoms. The polyamine preferably has a carbon-to-nitrogen ratio of from about 1:1 to 10:1.

The polyamine may be substituted with substituents selected from (a) hydrogen, (b) hydrocarbyl groups of from 1 to about 10 carbon atoms, (c) acyl groups of from 2 to about 10 carbon atoms, and (d) monoketo, monohydroxy, mononitro, monocyano, lower alkyl and lower alkoxy derivatives of (b) and (c). "Lower", as used in terms like lower alkyl or lower alkoxy, means a group containing from 1 to about 6 carbon atoms. At least one of the substituents on one of the basic nitrogen atoms of the polyamine is hydrogen, e.g., at least one of the basic nitrogen atoms of the polyamine is a primary or secondary amino nitrogen.

Hydrocarbyl, as used in describing the polyamine moiety on the aliphatic amine employed in this invention, denotes an organic radical composed of carbon and hydrogen which may be aliphatic, alicyclic, aromatic or combinations thereof, e.g., aralkyl. Preferably, the hydrocarbyl group will be relatively free of aliphatic unsaturation, i.e., ethylenic and acetylenic, particularly acetylenic unsaturation. The substituted polyamines of the present invention are generally, but not necessarily, N-substituted polyamines. Exemplary hydrocarbyl groups and substituted hydrocarbyl groups include alkyls such as methyl, ethyl, propyl, butyl, isobutyl, pentyl, hexyl, octyl, etc., alkenyls such as propenyl, isobutenyl, hexenyl, octenyl, etc., hydroxyalkyls, such as 2-hydroxyethyl, 3-hydroxypropyl, hydroxy-isopropyl, 4-hydroxybutyl, etc., ketoalkyls, such as 2-ketopropyl, 6-ketooctyl, etc., alkoxy and lower alkenoxy alkyls, such as ethoxyethyl, ethoxypropyl, propoxyethyl, propoxypropyl, diethyleneoxymethyl, triethyleneoxyethyl, tetraethyleneoxyethyl, diethyleneoxyhexyl, etc. The aforementioned acyl groups (c) are such as propionyl, acetyl, etc. The more preferred substituents are hydrogen, $C_1$–$C_6$ alkyls and $C_1$–$C_6$ hydroxyalkyls.

In a substituted polyamine, the substituents are found at any atom capable of receiving them. The substituted atoms, e.g., substituted nitrogen atoms, are generally geometrically unequivalent, and consequently the substituted amines finding use in the present invention can be mixtures of mono- and poly-substituted polyamines with substituent groups situated at equivalent and/or unequivalent atoms.

The more preferred polyamine finding use within the scope of the present invention is a polyalkylene polyamine, including alkylene diamine, and including substituted polyamines, e.g., alkyl and hydroxyalkyl-substituted polyalkylene polyamine. Preferably, the alkylene group contains from 2 to 6 carbon atoms, there being preferably from 2 to 3 carbon atoms between the nitrogen atoms. Such groups are exemplified by ethylene, 1,2-propylene, 2,2-dimethylpropylene, trimethylene, 1,3,2-hydroxypropylene, etc. Examples of such polyamines include ethylene diamine, diethylene triamine, di(trimethylene) triamine, dipropylene triamine, triethylene tetraamine, tripropylene tetraamine, tetraethylene pentamine, and pentaethylene hexamine. Such amines encompass isomers such as branched-chain polyamines and previously-mentioned substituted polyamines, including hydroxy- and hydrocarbyl-substituted polyamines. Among the polyalkylene polyamines, those containing 2–12 amino nitrogen atoms and 2–24 carbon atoms are especially preferred, and the $C_2$–$C_3$ alkylene polyamines are most preferred, that is, ethylene diamine, polyethylene polyamine, propylene diamine and polypropylene polyamine, and in particular, the lower polyalkylene polyamines, e.g., ethylene diamine, dipropylene triamine, etc. Particularly preferred polyalkylene polyamines are ethylene diamine and diethylene triamine.

The amine component of the presently employed aliphatic amine fuel additive also may be derived from heterocyclic polyamines, heterocyclic substituted amines and substituted heterocyclic compounds, wherein the heterocycle comprises one or more 5–6 membered rings containing oxygen and/or nitrogen. Such heterocyclic rings may be saturated or unsaturated and substituted with groups selected from the aforementioned (a), (b), (c) and (d). The heterocyclic compounds are exemplified by piperazines, such as 2-methylpiperazine, N-(2-hydroxyethyl)-piperazine, 1,2-bis-(N-piperazinyl) ethane and N,N'-bis(N-piperazinyl)piperazine, 2-methylimidazoline, 3-aminopiperidine, 3-aminopyridine, N-(3-aminopropyl)-morpholine, etc. Among the heterocyclic compounds, the piperazines are preferred.

Typical polyamines that can be used to form the aliphatic amine additives employed in this invention by reaction with a hydrocarbyl halide include the following: ethylene diamine, 1,2-propylene diamine, 1,3-propylene diamine, diethylene triamine, triethylene tetramine, hexamethylene diamine, tetraethylene pentamine, dimethylaminopropylene diamine, N-(beta-aminoethyl)piperazine, N-(beta-aminoethyl)piperidine, 3-amino-N-ethylpiperidine, N-(beta-aminoethyl) morpholine, N,N'-di(beta-aminoethyl) piperazine, N,N'-di(beta-aminoethyl)imidazolidone-2, N-(beta-cyanoethyl) ethane-1,2-diamine, 1-amino-3,6,9-triazaoctadecane, 1-amino-3,6-diaza-9-oxadecane, N-(beta-aminoethyl) diethanolamine, N'-acetylmethyl-N-(beta-aminoethyl) ethane-1,2-diamine, N-acetonyl-1,2-propanediamine, N-(beta-nitroethyl)-1,3-propane diamine, 1,3-dimethyl-5(beta-aminoethyl)hexahydrotriazine, N-(beta-aminoethyl)-hexahydrotriazine, 5-(beta-aminoethyl)-1,3,5-dioxazine, 2-(2-aminoethylamino) ethanol, and 2-[2-(2-aminoethylamino) ethylamino]ethanol.

Alternatively, the amine component of the presently employed aliphatic hydrocarbyl-substituted amine may be derived from an amine having the formula:

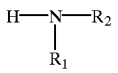

wherein $R_1$ and $R_2$ are independently selected from the group consisting of hydrogen and hydrocarbyl of 1 to about 20 carbon atoms and, when taken together, $R_1$ and $R_2$ may form one or more 5- or 6-membered rings containing up to about 20 carbon atoms. Preferably, $R_1$ is hydrogen and $R_2$ is a hydrocarbyl group having 1 to about 10 carbon atoms. More preferably, $R_1$ and $R_2$ are hydrogen. The hydrocarbyl groups may be straight-chain or branched and may be aliphatic, alicyclic, aromatic or combinations thereof. The hydrocarbyl groups may also contain one or more oxygen atoms.

An amine of the above formula is defined as a "secondary amine" when both $R_1$ and $R_2$ are hydrocarbyl. When $R_1$ is hydrogen and $R_2$ is hydrocarbyl, the amine is defined as a "primary amine"; and when both $R_1$ and $R_2$ are hydrogen, the amine is ammonia.

Primary amines useful in preparing the aliphatic hydrocarbyl-substituted amine fuel additives of the present invention contain 1 nitrogen atom and 1 to about 20 carbon atoms, preferably 1 to 10 carbon atoms. The primary amine may also contain one or more oxygen atoms.

Preferably, the hydrocarbyl group of the primary amine is methyl, ethyl, propyl, butyl, pentyl, hexyl, octyl, 2-hydroxyethyl or 2-methoxyethyl. More preferably, the hydrocarbyl group is methyl, ethyl or propyl.

Typical primary amines are exemplified by N-methylamine, N-ethylamine, N-n-propylamine, N-isopropylamine, N-n-butylamine, N-isobutylamine, N-sec-butylamine, N-tert-butylamine, N-n-pentylamine, N-cyclopentylamine, N-n-hexylamine, N-cyclohexylamine, N-octylamine, N-decylamine, N-dodecylamine, N-octadecylamine, N-benzylamine, N-(2-phenylethyl) amine, 2-aminoethanol, 3-amino-1-proponal, 2-(2-aminoethoxy)ethanol, N-(2-methoxyethyl)amine, N-(2-ethoxyethyl)amine, and the like. Preferred primary amines are N-methylamine, N-ethylamine and N-n-propylamine.

The amine component of the presently employed aliphatic hydrocarbyl-substituted amine fuel additive may also be derived from a secondary amine. The hydrocarbyl groups of the secondary amine may be the same or different and will generally contain 1 to about 20 carbon atoms, preferably 1 to about 10 carbon atoms. One or both of the hydrocarbyl groups may also contain one or more oxygen atoms.

Preferably, the hydrocarbyl groups of the secondary amine are independently selected from the group consisting of methyl, ethyl, propyl, butyl, pentyl, hexyl, 2-hydroxyethyl and 2-methoxyethyl. More preferably, the hydrocarbyl groups are methyl, ethyl or propyl.

Typical secondary amines which may be used in this invention include N,N-dimethylamine, N,N-diethylamine, N,N-di-n-propylamine, N,N-diisopropylamine, N,N-di-n-butylamine, N,N-di-sec-butylamine, N,N-di-n-pentylamine, N,N-di-n-hexylamine, N,N-dicyclohexylamine, N,N-dioctylamine, N-ethyl-N-methylamine, N-methyl-N-n-propylamine, N-n-butyl-N-methylamine, N-methyl-N-octylamine, N-ethyl-N-isopropylamine, N-ethyl-N-octylamine, N,N-di(2-hydroxyethyl)amine, N,N-di(3-hydroxypropyl)amine, N,N-di(ethoxyethyl)amine, N,N-di (propoxyethyl)amine, and the like. Preferred secondary amines are N,N-dimethylamine, N,N-diethylamine and N,N-di-n-propylamine.

Cyclic secondary amines may also be employed to form the aliphatic amine additives of this invention. In such cyclic compounds, $R_1$ and $R_2$ of the formula hereinabove, when taken together, form one or more 5- or 6-membered rings containing up to about 20 carbon atoms. The ring containing the amine nitrogen atom is generally saturated, but may be fused to one or more saturated or unsaturated rings. The rings may be substituted with hydrocarbyl groups of from 1 to about 10 carbon atoms and may contain one or more oxygen atoms.

Suitable cyclic secondary amines include piperidine, 4-methylpiperidine, pyrrolidine, morpholine, 2,6-dimethylmorpholine, and the like.

In many instances, the amine component is not a single compound but a mixture in which one or several compounds predominate with the average composition indicated. For example, tetraethylene pentamine prepared by the polymerization of aziridine or the reaction of dichloroethylene and ammonia will have both lower and higher amine members, e.g., triethylene tetraamine, substituted piperazines and pentaethylene hexamine, but the composition will be mainly tetraethylene pentamine and the empirical formula of the total amine composition will closely approximate that of tetraethylene pentamine. Finally, in preparing the compounds of this invention using a polyamine, where the various nitrogen atoms of the polyamine are not geometrically equivalent, several substitutional isomers are possible and are encompassed within the final product. Methods of preparation of amines and their reactions are detailed in Sidgewick's "The Organic Chemistry of Nitrogen", Clarendon Press, Oxford, 1966; Noller's "Chemistry of Organic Compounds", Saunders, Philadelphia, 2nd Ed., 1957; and Kirk-Othmer's "Encyclopedia of Chemical Technology", 2nd Ed., especially Volume 2, pp. 99–116.

Preferred aliphatic hydrocarbyl-substituted amines suitable for use in the present invention are hydrocarbyl-substituted polyalkylene polyamines having the formula:

$$R_3NH—(R_4—NH)_n—H$$

wherein $R_3$ is a hydrocarbyl group having a number average molecular weight of about 700 to 3,000; $R_4$ is alkylene of from 2 to 6 carbon atoms; and n is an integer of from 0 to about 10.

Preferably, $R_3$ is a hydrocarbyl group having a number average molecular weight of about 750 to 2,200, more preferably, from about 900 to 1,500. Preferably, $R_4$ is alkylene of from 2 to 3 carbon atoms and n is preferably an integer of from 1 to 6.

B. The Hydrocarbyl-Terminated Poly(oxyalkylene) Monool

The hydrocarbyl-terminated poly(oxyalkylene) polymers employed in the present invention are monohydroxy compounds, i.e., alcohols, often termed monohydroxy polyethers, or polyalkylene glycol monohydrocarbylethers, or "capped" poly(oxyalkylene) glycols and are to be distinguished from the poly(oxyalkylene) glycols (diols), or polyols, which are not hydrocarbyl-terminated, i.e., not capped. The hydrocarbyl-terminated poly(oxyalkylene) alcohols are produced by the addition of lower alkylene oxides, such as ethylene oxide, propylene oxide, the butylene oxides, or the pentylene oxides to the hydroxy compound $R_5OH$ under polymerization conditions, wherein $R_5$ is the hydrocarbyl group which caps the poly(oxyalkylene) chain. Methods of production and properties of these polymers are disclosed in U.S. Pat. Nos. 2,841,479 and 2,782,240 and Kirk-Othmer's "Encyclopedia of Chemical Technology", 2nd Ed., Volume 19, p. 507. In the polymerization reaction, a single type of alkylene oxide may be employed, e.g., propylene oxide, in which case the product is a homopolymer, e.g., a poly(oxyalkylene) propanol. However, copolymers are equally satisfactory and random copolymers are readily prepared by contacting the hydroxyl-containing compound with a mixture of alkylene oxides, such as a mixture of propylene and butylene oxides. Block copolymers of oxyalkylene units also provide satisfactory poly(oxyalkylene) polymers for the practice of the present invention. Random polymers are more easily prepared when the reactivities of the oxides are relatively equal. In certain cases, when ethylene oxide is copolymerized with other oxides, the higher reaction rate of ethylene oxide makes the preparation of random copolymers difficult. In either case, block copolymers can be prepared. Block copolymers are prepared by contacting the hydroxyl-containing compound with first one alkylene oxide, then the others in any order, or repetitively, under polymerization conditions. A particular block copolymer is represented by a polymer prepared by polymerizing propylene oxide on a suitable monohydroxy compound to form a poly(oxypropylene) alcohol and then polymerizing butylene oxide on the poly(oxyalkylene) alcohol.

In general, the poly(oxyalkylene) polymers are mixtures of compounds that differ in polymer chain length. However, their properties closely approximate those of the polymer represented by the average composition and molecular weight. The polyethers employed in this invention can be represented by the formula:

$$R_5O—(R_6O)_p—H$$

wherein $R_5$ is a hydrocarbyl group of from 1 to 30 carbon atoms; $R_6$ is a $C_2$ to $C_5$ alkylene group; and p is an integer such that the molecular weight of the polyether is from about 500 to about 5,000.

Preferably, $R_6$ is a $C_3$ or $C_4$ alkylene group.

Preferably, $R_5$ is a $C_7$–$C_{30}$ alkylphenyl group. Most preferably, $R_5$ is dodecylphenyl.

Preferably, the polyether has a molecular weight of from about 750 to about 3,000; and more preferably from about 900 to about 1,500.

Fuel Compositions

The fuel additive composition employed in the present invention will generally be employed in a hydrocarbon distillate fuel boiling in the gasoline or diesel range. The proper concentration of this additive composition necessary in order to achieve the desired detergency and dispersancy varies depending upon the type of fuel employed, the presence of other detergents, dispersants and other additives, etc. Generally, however, from about 85 to below about 145 ppm by weight, preferably from about 90 to 140 ppm, of the present additive composition per part of base fuel is needed to achieve the best results.

In terms of individual components, fuel compositions containing the additive composition employed in the invention will generally contain about 50 to 70 ppm by weight of the aliphatic hydrocarbyl-substituted amine and about 35 to below about 75 ppm, preferably about 40 to 70 ppm, by weight of the poly(oxyalkylene) monool. The ratio of poly (oxyalkylene) monool to aliphatic amine (monool:amine) will generally be in the range of about 0.5:1 to about 1.5:1.

The deposit control fuel additive composition employed in the invention may be formulated as a concentrate, using an inert stable oleophilic (i.e., dissolves in gasoline or diesel fuel) organic solvent boiling in the range of about 150° F. to 400° F. (about 65° C. to 205° C.). Preferably, an aliphatic or an aromatic hydrocarbon solvent is used, such as benzene, toluene, xylene or higher-boiling aromatics or aromatic thinners. Aliphatic alcohols of about 3 to 8 carbon atoms, such as isopropanol, isobutylcarbinol, n-butanol and the like, in combination with hydrocarbon solvents are also suitable for use with the detergent-dispersant additive. In the concentrate, the amount of the presently employed additive composition will be ordinarily at least 10% by weight and generally not exceed 90% by weight, preferably 40 to 85 weight percent and most preferably from 50 to 80 weight percent.

In gasoline fuels, other fuel additives may be employed with the additives used in the present invention, including, for example, oxygenates, such as t-butyl methyl ether, antiknock agents, such as methylcyclopentadienyl manganese tricarbonyl, and other dispersants/detergents, such as various hydrocarbyl amines, hydrocarbyl poly(oxyalkylene) amines, or succinimides. Also included may be lead scavengers, such as aryl halides, e.g., dichlorobenzene, or alkyl halides, e.g., ethylene dibromide. Additionally, antioxidants, metal deactivators, pour point depressants, corrosion inhibitors, demulsifiers and anti-valve seat recession agents may be present. The gasoline fuels may also contain amounts of other fuels such as, for example, methanol.

Additional fuel additives which may be present include fuel injector inhibitors, low molecular weight fuel injector detergents, and carburetor detergents, such as a low molecular weight hydrocarbyl amine, including polyamines, having a molecular weight below 700, such as oleyl amine or a low molecular weight polyisobutenyl ethylene diamine, for example, where the polyisobutenyl group has a number average molecular weight of about 420.

In diesel fuels, other well-known additives can be employed, such as pour point depressants, flow improverse, cetane improvers, and the like. The diesel fuels can also include other fuels such as, for example, methanol.

A fuel-soluble, nonvolatile carrier fluid or oil may also be used with the fuel additive composition employed in this invention. The carrier fluid is a chemically inert hydrocarbon-soluble liquid vehicle which substantially increases the nonvolatile residue (NVR), or solvent-free liquid fraction of the fuel additive composition while not overwhelmingly contributing to octane requirement increase. The carrier fluid may be a natural or synthetic oil, such as mineral oil or refined petroleum oils.

These carrier fluids are believed to act as a carrier for the fuel additives of the present invention and to assist in removing and retarding deposits. The carrier fluid may also exhibit synergistic deposit control properties when used in combination with a fuel additive composition employed in this invention.

The carrier fluids are typically employed in amounts ranging from about 25 to about 5,000 ppm by weight of the hydrocarbon fuel, preferably from about 35 to 800 ppm of the fuel. Preferably, the ratio of carrier fluid to deposit control additive will range from about 0.2:1 to about 10:1, more preferably from about 0.5:1 to about 3:1.

When employed in a fuel concentrate, carrier fluids will generally be present in amounts ranging from about 10 to about 60 weight percent, preferably from 20 to 40 weight percent.

The following examples are presented to illustrate specific embodiments of this invention and are not to be construed in any way as limiting the scope of the invention.

EXAMPLES

Example 1

BMW Mileage Accumulator Test

The fuel composition of the present invention was tested in a BMW vehicle to evaluate its intake valve deposit control performance. The BMW was equipped with a 1.8 liter, port fuel injected, 4-cylinder overhead cam engine manufactured by BMW. Vehicle preparations were conducted in accordance with ASTM D 5500, unless specified otherwise.

Mileage accumulation was conducted on a chassis dynamometer using the driving cycle specified in Table I.

TABLE 1

Test Method Driving Cycle

| Mode | Total Distance % | Average Speed mph | Distance miles |
|---|---|---|---|
| AMA City Portion | 10 | 36 | 80 |
| Suburban | 20 | 40 | 166 |
| Highway | 70 | 65 | 560 |
| Total | 100 | 45 | 800 |

At the end of each test run, the intake valves were removed, washed with hexane, and weighed. The previously determined weights of the clean valves were subtracted from the weights of the valves at the end of the run. The difference between the two weights is the weight of the intake valve deposit (IVD).

The base fuel employed was a regular octane unleaded gasoline containing no deposit control additive. The test compounds were admixed with the base fuel to give the concentrations indicated in the tables.

The test was run for 5,000 miles on the test fuel. The amount of carbonaceous deposit in milligrams on the intake valves is reported for each of the test samples in Table II.

TABLE II

BMW 5,000 Mile Results

| Sample | Amine[a], ppma | Monool[b], ppm | Ratio (Monool/Amine) | Intake Valve Deposit Weight, mg |
|---|---|---|---|---|
| Base Fuel | | | | 281 |
| No. 1[c] | 80 | 115 | 1.4 | 44 |
| No. 2[c] | 30 | 115 | 3.8 | 254 |
| No. 3[c] | 80 | 30 | 0.38 | 117 |
| No. 4[c] | 30 | 30 | 1 | 345 |
| No. 5 | 68.5 | 57 | 0.83 | 57 |
| No. 6 | 60 | 40 | 0.67 | 54 |

[a]Polyisobutenyl (1300 MW) ethylene diamine, in parts per million actives (ppma).
[b]Dodecylphenyl poly (oxypropylene) monool having an average molecular weight of about 1000, in parts per million (ppm).
[c]Comparative samples.

The data in Table II demonstrates that the combination of aliphatic amine and poly(oxyalkylene) monool additives at very low concentrations in fuels (Sample Nos. 5 and 6) provides excellent deposit control performance which is significantly better than would be predicted from a linear combination of these additives.

Additional testing was obtained in a 10,000 mile BMW test as specified in ASTM D 5500. An average deposit weight of 100 milligrams per valve or less at the conclusion of the 10,000 mile test meets BMW requirements for unlimited mileage acceptance. The results are set forth in Table III.

TABLE III

BMW 10,000 Mile Results

| Sample | Amine[a], ppma | Monool[b], ppm | Ratio (Monool/Amine) | Intake Valve Deposit Weight, mg |
|---|---|---|---|---|
| Base Fuel A | | | | 158 |
| Base Fuel A | | | | 281 |
| Base Fuel A | | | | 238 |
| Base Fuel B | | | | 360 |
| Base Fuel B | | | | 300 |
| No. 1[c] | 53 | 42.5 | 0.8 | 75 |
| No. 2[d] | 53 | 42.5 | 0.8 | 86 |

[a]Polyisobutenyl (1300 MW) ethylene diamine, in parts per million actives (ppma).
[b]Dodecylphenyl poly (oxypropylene) monool having an average molecular weight of about 1000, in parts per million (ppm).
[c]Formulated in Base Fuel A.
[d]Formulated in Base Fuel B.

The data in Table III illustrates the significant reduction in intake valve deposits provided by the fuel composition of the present invention (Sample Nos. 1 and 2) compared to the base fuel and shows that the instant fuel composition passes the BMW unlimited mileage test at a very low concentration of additives.

What is claimed is:

1. A fuel composition comprising a major amount of hydrocarbons boiling in the gasoline or diesel range and (a) about 50 to 70 parts per million by weight of a fuel-soluble aliphatic hydrocarbyl-substituted amine having at least one basic nitrogen atom wherein the hydrocarbyl group has a number average molecular weight of about 700 to 3,000; and (b) about 35 to below about 75 parts per million by weight of a hydrocarbyl-terminated poly(oxyalkylene) monool having an average molecular weight of about 500 to about 5,000, wherein the oxyalkylene group is a $C_2$ to $C_5$ oxyalkylene group and the hydrocarbyl group is a $C_1$ to $C_{30}$ hydrocarbyl group; and wherein the ratio of poly(oxyalkylene) monool to aliphatic amine is in the range of about 0.5:1 to about 1.5:1.

2. The fuel composition according to claim 1, wherein the hydrocarbyl substituent on the aliphatic amine of component (a) has a number average molecular weight of about 750 to 2,200.

3. The fuel composition according to claim 2, wherein the hydrocarbyl substituent on the aliphatic amine of component (a) has a number average molecular weight of about 900 to 1,500.

4. The fuel composition according to claim 1, wherein the aliphatic amine of component (a) is a branched chain hydrocarbyl-substituted amine.

5. The fuel composition according to claim 4, wherein the aliphatic amine of component (a) is a polyisobutenyl amine.

6. The fuel composition according to claim 4, wherein the amine moiety of the aliphatic amine is derived from a polyamine having from 2 to 12 amine nitrogen atoms and from 2 to 40 carbon atoms.

7. The fuel composition according to claim 6, wherein the polyamine is a polyalkylene polyamine having 2 to 12 amine nitrogen atoms and 2 to 24 carbon atoms.

8. The fuel composition according to claim 7, wherein the polyalkylene polyamine is selected from the group consisting of ethylene diamine, diethylene triamine, triethylene tetramine and tetraethylene pentamine.

9. The fuel composition according to claim 8, wherein the polyalkylene polyamine is ethylene diamine or diethylene triamine.

10. The fuel composition according to claim 9, wherein the aliphatic amine of component (a) is a polyisobutenyl ethylene diamine.

11. The fuel composition according to claim 1, wherein the hydrocarbyl-terminated poly(oxyalkylene) monool of component (b) has an average molecular weight of about 900 to 1500.

12. The fuel composition according to claim 1, wherein the oxyalkylene group of the hydrocarbyl-terminated poly (oxyalkylene) monool of component (b) is a $C_3$ to $C_4$ oxyalkylene group.

13. The fuel composition according to claim 12, wherein the oxyalkylene group of the hydrocarbyl-terminated poly (oxyalkylene) monool of component (b) is a oxypropylene group.

14. The fuel composition according to claim 12, wherein the oxyalkylene group of the hydrocarbyl-terminated poly (oxyalkylene) monool of component (b) is a oxybutylene group.

15. The fuel composition according to claim 1, wherein the hydrocarbyl group of the hydrocarbyl-terminated poly (oxyalkylene) monool of component (b) is a $C_7$ to $C_{30}$ alkylphenyl group.

16. The fuel composition according to claim 1, wherein the fuel composition contains about 40 to 70 parts per million by weight of the hydrocarbyl-terminated poly (oxyalkylene) monool of component (b).

17. The fuel composition according to claim 1, wherein component (a) is a polyisobutenyl amine, wherein the amine moiety is derived from ethylene diamine or diethylene triamine, and component (b) is a $C_7$ to $C_{30}$ alkylphenyl-terminated poly(oxypropylene) or poly(oxybutylene) monool.

18. A method for reducing engine deposits in an internal combustion engine which comprises operating the engine with a fuel composition comprising a major amount of hydrocarbons boiling in the gasoline or diesel range and (a) about 50 to 70 parts per million by weight of a fuel-soluble aliphatic hydrocarbyl-substituted amine having at least one basic nitrogen atom wherein the hydrocarbyl group has a number average molecular weight of about 700 to 3,000; and (b) about 35 to below about 75 parts per million by weight of a hydrocarbyl-teminated poly(oxyalkylene) monool having an average molecular weight of about 500 to about 5,000, wherein the oxyalkylene group is a $C_2$ to $C_5$ oxyalkylene group and the hydrocarbyl group is a $C_1$ to $C_{30}$ hydrocarbyl group; and wherein the ratio of poly(oxyalkylene) monool to aliphatic amine is in the range of about 0.5:1 to about 1.5:1.

19. The method according to claim 18, wherein the hydrocarbyl substituent on the aliphatic amine of component (a) has a number average molecular weight of about 750 to 2,200.

20. The method according to claim 19, wherein the hydrocarbyl substituent on the aliphatic amine of component (a) has a number average molecular weight of about 900 to 1,500.

21. The method according to claim 18, wherein the aliphatic amine of component (a) is a branched chain hydrocarbyl-substituted amine.

22. The method according to claim 21, wherein the aliphatic amine of component (a) is a polyisobutenyl amine.

23. The method according to claim 21, wherein the amine moiety of the aliphatic amine is derived from a polyamine having from 2 to 12 amine nitrogen atoms and from 2 to 40 carbon atoms.

24. The method according to claim 23, wherein the polyamine is a polyalkylene polyamine having 2 to 12 amine nitrogen atoms and 2 to 24 carbon atoms.

25. The method according to claim 24, wherein the polyalkylene polyamine is selected from the group consisting of ethylene diamine, diethylene triamine, triethylene tetramine and tetraethylene pentamine.

26. The method according to claim 25, wherein the polyalkylene polyamine is ethylene diamine or diethylene triamine.

27. The method according to claim 26, wherein the aliphatic amine of component (a) is a polyisobutenyl ethylene diamine.

28. The method according to claim 18, wherein the hydrocarbyl-terminated poly(oxyalkylene) monool of component (b) has an average molecular weight of about 900 to 1500.

29. The method according to claim 18, wherein the oxyalkylene group of the hydrocarbyl-terminated poly (oxyalkylene) monool of component (b) is a $C_3$ to $C_4$ oxyalkylene group.

30. The method according to claim 29, wherein the oxyalkylene group of the hydrocarbyl-terminated poly (oxyalkylene) monool of component (b) is a oxypropylene group.

31. The method according to claim 29, wherein the oxyalkylene group of the hydrocarbyl-terminated poly (oxyalkylene) monool of component (b) is a oxybutylene group.

32. The method according to claim 18, wherein the hydrocarbyl group of the hydrocarbyl-terminated poly (oxyalkylene) monool of component (b) is a $C_7$ to $C_{30}$ alkylphenyl group.

33. The method according to claim 18, wherein the fuel composition contains about 40 to 70 parts per million by weight of the hydrocarbyl-terminated poly(oxyalkylene) monool of component (b).

34. The method according to claim 18, wherein component (a) is a polyisobutenyl amine, wherein the amine moiety is derived from ethylene diamine or diethylene triamine and component (b) is a $C_7$ to $C_{30}$ alkylphenyl-terminated poly(oxypropylene) or poly(oxybutylene) monool.

* * * * *